US007341126B1

(12) United States Patent
Diggle, III et al.

(10) Patent No.: US 7,341,126 B1
(45) Date of Patent: Mar. 11, 2008

(54) LADDER SUPPORT SYSTEMS

(75) Inventors: Frederick James Diggle, III, Birmingham, AL (US); Paul Brent Rivers, Cullman, AL (US); Robert Clint Hogeland, Fultondale, AL (US)

(73) Assignee: AT&T Delaware Intellectual Property, Inc., Wilmington, DE (US)

( * ) Notice: Subject to any disclaimer, the term of this patent is extended or adjusted under 35 U.S.C. 154(b) by 0 days.

(21) Appl. No.: 10/639,389

(22) Filed: Aug. 12, 2003

(51) Int. Cl.
*E06C 7/00* (2006.01)

(52) U.S. Cl. ..... 182/93; 182/107

(58) Field of Classification Search ..... 182/107, 182/206, 214, 93
See application file for complete search history.

(56) References Cited

U.S. PATENT DOCUMENTS 675,545 A 6/1901 Hatch
1,964,067 A * 6/1934 Leach et al. ..... 182/213
2,808,975 A * 10/1957 Palmquist ..... 182/107
3,590,951 A 7/1971 Berger
4,089,390 A 5/1978 McLain
5,012,895 A * 5/1991 Santos ..... 182/204
5,165,641 A * 11/1992 Southern ..... 248/230.1
5,673,768 A * 10/1997 Schmitt et al. ..... 182/129
5,797,571 A 8/1998 Brophy
5,816,365 A * 10/1998 Ruth ..... 182/206
5,850,894 A * 12/1998 Busenhart ..... 182/214
6,354,400 B1 * 3/2002 Purkayastha ..... 182/107
6,390,236 B1 * 5/2002 Eastman ..... 182/107

OTHER PUBLICATIONS

U.S. Appl. No. 10/657,324, filed Sep. 8, 2003.
U.S. Appl. No. 10/662,854, filed Sep. 15, 2003.
U.S. Appl. No. 10/662,855, filed Sep. 15, 2003.
Extension Ladder Accessories; Jul. 14, 2003; http://www.wernerladder.com/acc-ext.htm.

* cited by examiner

*Primary Examiner*—Alvin Chin-Shue
(74) *Attorney, Agent, or Firm*—Scott P. Zimmerman, PLLC; Geoff Sutcliffe; Jodi Hartman

(57) ABSTRACT

A ladder support system that may be mounted on a ladder rung or other securing structures and may further be shaped to provide lateral support to the ladder when a pole or other supporting structure is positioned on the ladder support. The ladder support may also be configured for convenient mounting and removal from the securing structure to which it may be mounted. The ladder support may be resilient and may have a slit along the length of the support to provide releasable mounting on the ladder.

3 Claims, 8 Drawing Sheets

LADDER SUPPORT SYSTEMS

BACKGROUND

The subject invention generally and in various embodiments relates to ladder support systems, and more particularly to devices for supporting ladders in a stable lateral position when employed for climbing.

Ladder supports for stabilizing ladders are generally known and used to prevent undesirable shifting and rotation of a ladder when in use. Ladders are commonly placed against supporting structures such as walls, rafters, poles, etc. Existing ladder stabilizers are generally of two types. The first type is a V-shaped device that is wider than the width of the ladder to which it is attached. The ends of the stabilizer are capped with non-slip caps that contact the supporting structure. The second type of stabilizer is a V-shaped device that fits between the side beams of a ladder and is adapted to stabilize a ladder that is supported by a pole. The stabilizer is shaped such that the cradle of the "V" contacts the pole.

SUMMARY OF THE INVENTION

In accordance with embodiments of the invention, there may be provided a ladder support for a ladder having at least one rung. The ladder support may have a first support member that may be mounted on a ladder rung and a second support member mounted on another portion of the ladder rung. The first and second support members may be shaped to provide lateral support when a supporting structure is positioned between the first and second support members.

Another embodiment of the invention may include a ladder support system having a first and a second support portion for mounting on a ladder rung. The first and second support portions may be configured substantially similar to one another and may be shaped to provide lateral support to the ladder by positioning the supporting structure within a receiving area of the first and second support portions.

Another embodiment of the invention may include a ladder support for a ladder with at least one rung having a first and a second means for laterally supporting a ladder. The first and second means are adapted for mounting on different portions of a ladder rung and are shaped such that lateral support is provided when a supporting structure is positioned between the first and second support means.

Accordingly, the present invention provides solutions to the shortcomings of prior devices and methods for stabilizing ladders. Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

In the accompanying Figures, there are shown embodiments of the present invention wherein like reference numerals are employed to designate like parts and wherein.

DESCRIPTION

Figure 1:
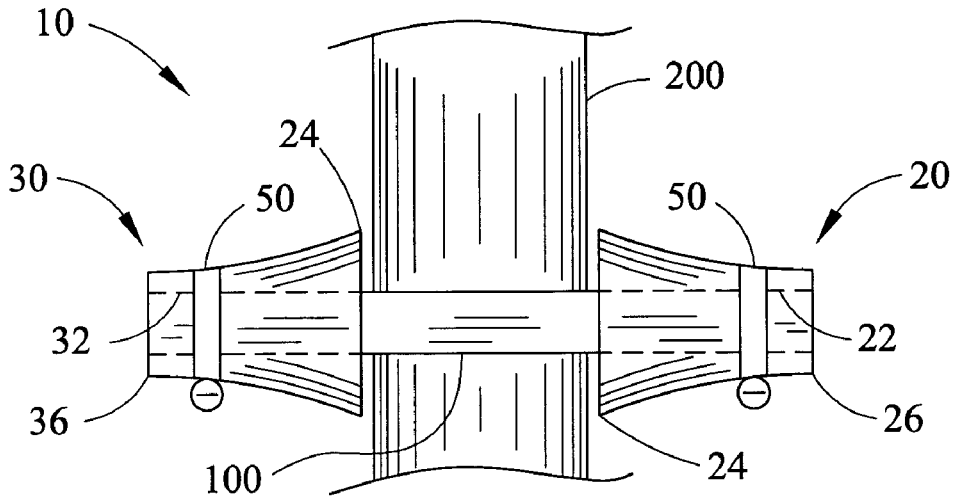
FIG. 1 is a front view of an embodiment of a ladder support system of the present invention.
Figure 2:
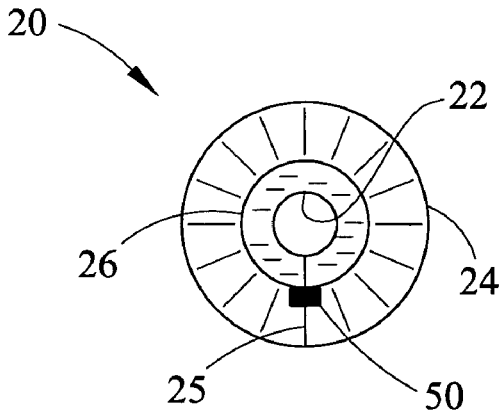
FIG. 2 is a side view of the ladder support of FIG. 1.
Figure 3:
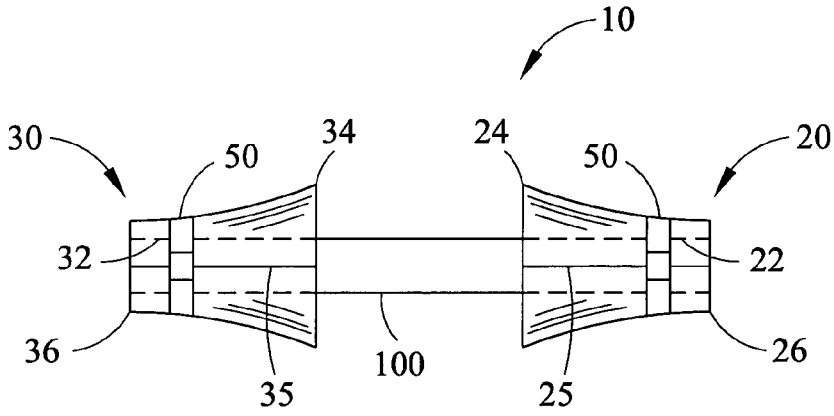
FIG. 3 is a bottom view of the ladder support of FIG. 1.

Referring now to the drawings for the purposes of illustrating embodiments of the invention only and not for the purposes of limiting the same, FIGS. 1-3 illustrate embodiments of the present invention. A ladder support system 10 may generally include a first support member 20 and a second support member 30. The ladder support system 10 may be mounted on securing structures 100, such as, for example, ladder rungs, ladder beams, etc. by fasteners 50. The first support member 20 and second support member 30 may also be shaped to provide lateral support to a ladder (not shown) when a supporting structure 200 is positioned between the two support members 20, 30.

As can be seen in FIGS. 2-3, first support member 20 may have an inner abutment end 24 and an outer abutment end 26 for preventing lateral movement about a supporting structure 200 such as, for example, a pole tree, corner of building, etc. Second support member 30 may likewise have an inner abutment end 34 and an outer abutment end 36 for preventing lateral movement about a supporting structure 200. The inner abutment ends 24, 34 provide lateral support in conjunction with the outer abutment ends 26, 36 as they are positioned between the beams (not shown) of a ladder on an outer end and the supporting structure 200 on an inner end. Thus, the ladder is supported laterally by each of the first and second support members 20, 30 being wedged between a ladder beam (not shown) and the supporting structure 200.

First and second support members 20, 30 may be repositionable and removably mounted on portions of the securing structure 100 by, for example, one or more fasteners 50. Fasteners 50 may include, for example, latches, cotter pins, plastic ties, snap locks, etc. The first support member may have a slit 25, a show in FIG. 2-3, and may further be constructed of a resilient material. The second support member may also have a slit 35 shown in FIG. 3 and may also be constructed of a resilient material. The first support member 20 may further have a securing surface 22 and second support member 30 may further having a securing surface 32 for engaging the securing structure 100. Securing surfaces 22, 32 may also be textured in further embodiments of the invention to improve contact with the securing structure 100. First and second support members 20, 30 may be fabricated from, for example, rubber, polyurethane, plastic, aluminum, etc. The support members 20, 30 may also be fabricated from, for example, any durable and/or deformable resilient material capable of being reconfigured such that the original shape returns once the deforming force is removed.

Various embodiments described herein may include retrofitting the ladder support system 10 onto a securing structure 100, where the first and second support members 20, 30 may be pried open about their slits 25, 35. Once opened, the first and second support members 20, 30 may then be placed around a ladder rung 100 and placed at opposite ends of the ladder rung 100 wherein the first support member 20 may be positioned on the ladder rung 100 and the second support member 30 may be positioned on another portion of the ladder rung 100. In various embodiments, due to the resilient nature of the material used for construction, the first and second support members 20, 30 return to their undeformed position as illustrated when the deforming force is removed. While the support members 20, 30 are in a desired location, either at the extremities of the ladder rung 100 against the ladder beam (mot shown) or somewhere in between, the ladder support system 10 may further be secured in place with fasteners 50. A desired position may include a position that places inner abutment ends 24, 34 against the supporting structure 200 to prevent lateral movement. Although fasteners 50 are optional in several cases such as, for example, where the first and second support members 20, 30 fit snugly between the ladder beam (not shown) and the supporting structure 200, they may be additionally used to assist in securing the ladder support system 10 in a desired position.

Other methods of attaching the ladder support system 10 are within the spirit and scope of the embodiments of the invention. First and/or second support members 20, 30 may attach directly to the sides of the ladder beams (not shown) via, for example, snap fittings or threaded attachment means. In addition, the support members 20, 30 may also slide into molded fittings (not shown) retrofitted onto existing ladder beams.

Further implementations for allowing the ladder support system 10 to open for positioning around a securing structure 100 are within the spirit and scope of the invention as well. The addition of hinges (not shown), as well as other like implementations may be used to assist in the separation of the first support member 20 into several smaller members such that positioning them around a ladder rung 100 may be accomplished with less force. The second support member 30 may likewise be partitioned into smaller portions connected together with hinges.

The first support member 20 and second support member 30 may also be shaped in a somewhat frustoconical shape to provide lateral support to a ladder (not shown). However, other shapes may be employed for laterally supporting a ladder when the supporting structure 200 is positioned between the two support members 20, 30. Other shapes may include, for example, a ring, a toroid, blocks, etc.

Figure 4:
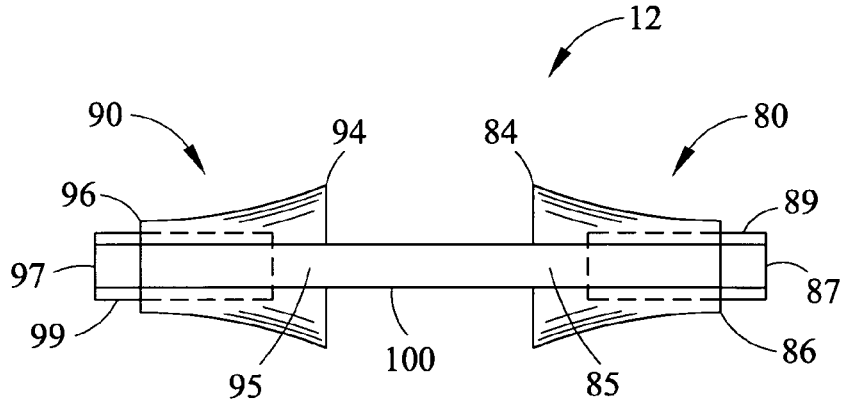
FIG. 4 is a front view of an embodiment of a ladder support system of the present invention.
Figure 5:
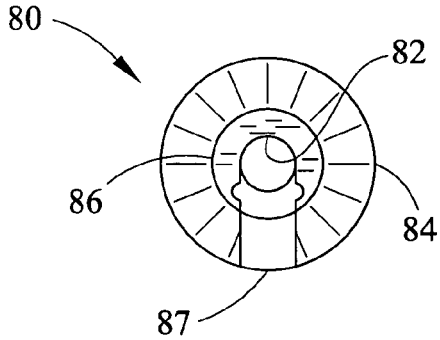
FIG. 5 is a side view of the ladder support of FIG. 4.

FIGS. 4 and 5 illustrate another embodiment that may include a ladder support system 12 and may have a first support member 80 having a slot 85 for receiving an insert 87 for positioning within the slot 85 to mount and fasten the ladder support system 12 around a securing structure 100. The insert 87 may also have notches 89 that help secure the insert 87 in the slot 85. A second support member 90 may also have a similar structure to fasten to the securing structure 100 that may include a slot 95 provided to receive and insert 97. The insert 97 may have notches 99 to assist in securing the insert 97 to the slot 95.

Figure 6:
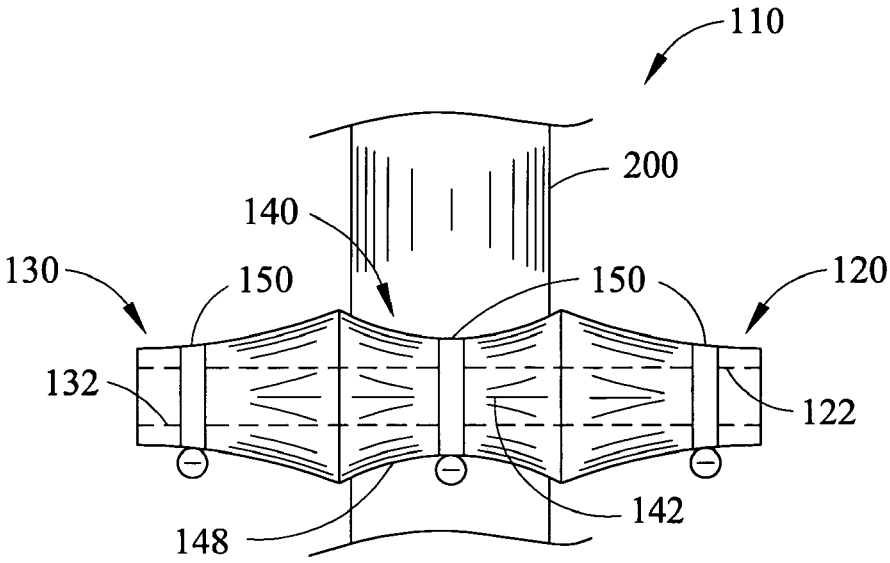
FIG. 6 is a front view of an embodiment of a ladder support system of the present invention.
Figure 7:
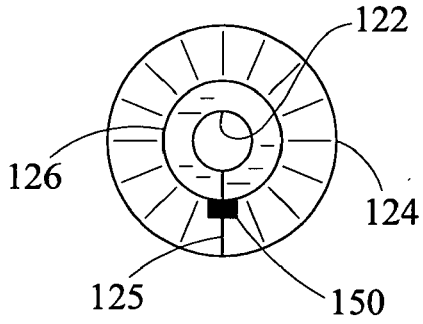
FIG. 7 is a side view of the ladder support of FIG. 6.
Figure 8:
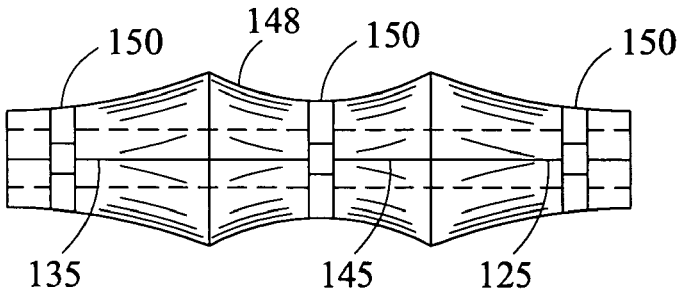
FIG. 8 is a bottom view of the ladder support of FIG. 6.
Figure 9:
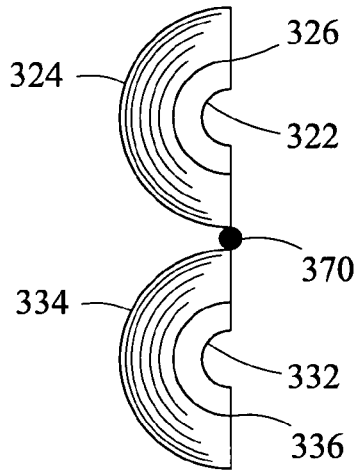
FIG. 9 is a side view of an embodiment of a ladder support system of the present invention in an open position.
Figure 10:
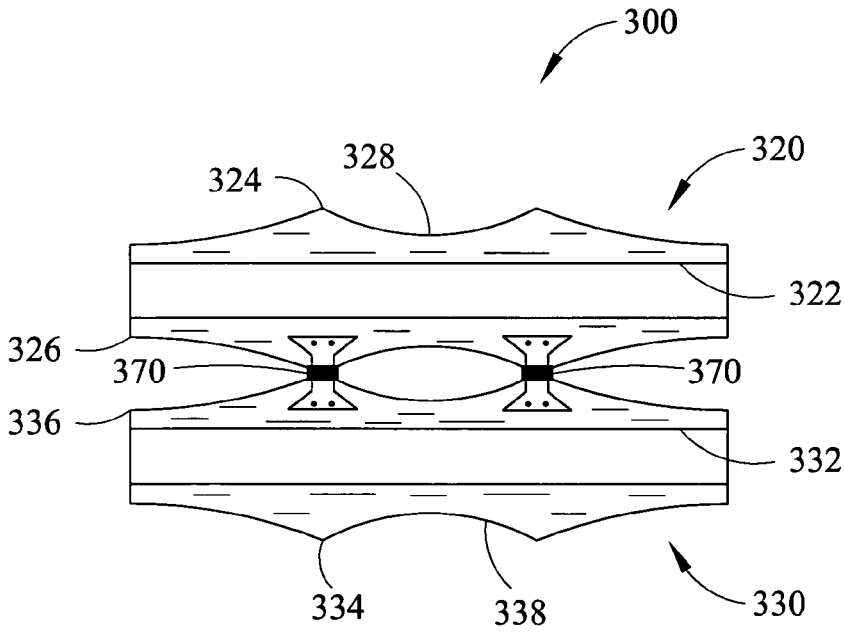
FIG. 10 is a front view of the ladder support of FIG. 9.
Figure 11:
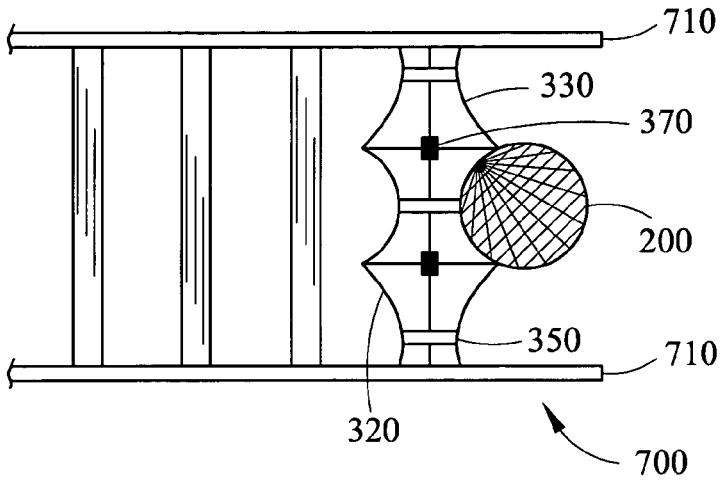
FIG. 11 is a top elevational view of the ladder support system of FIG. 7 as it may be employed.
Figure 12:
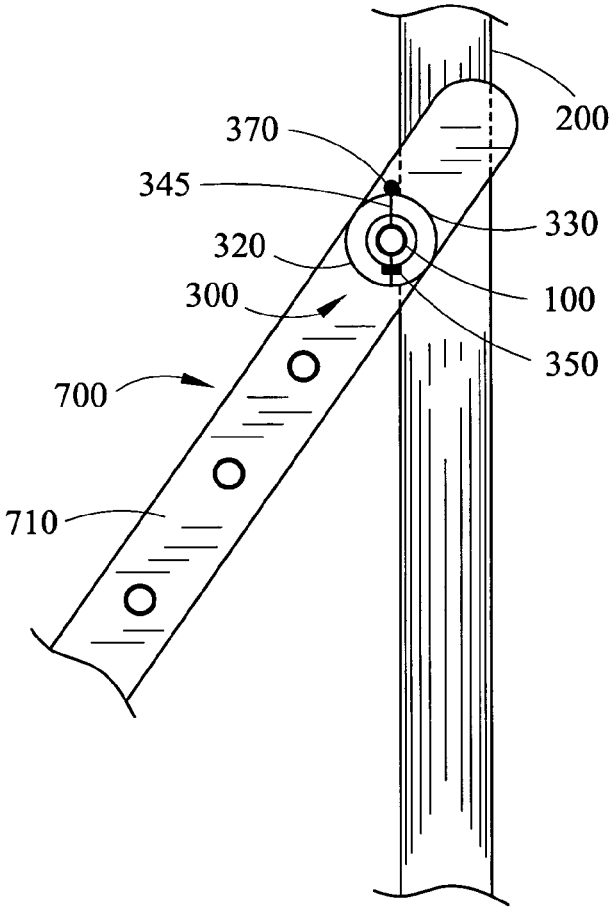
FIG. 12 is side view of the ladder support of FIG. 11.
Figure 13:
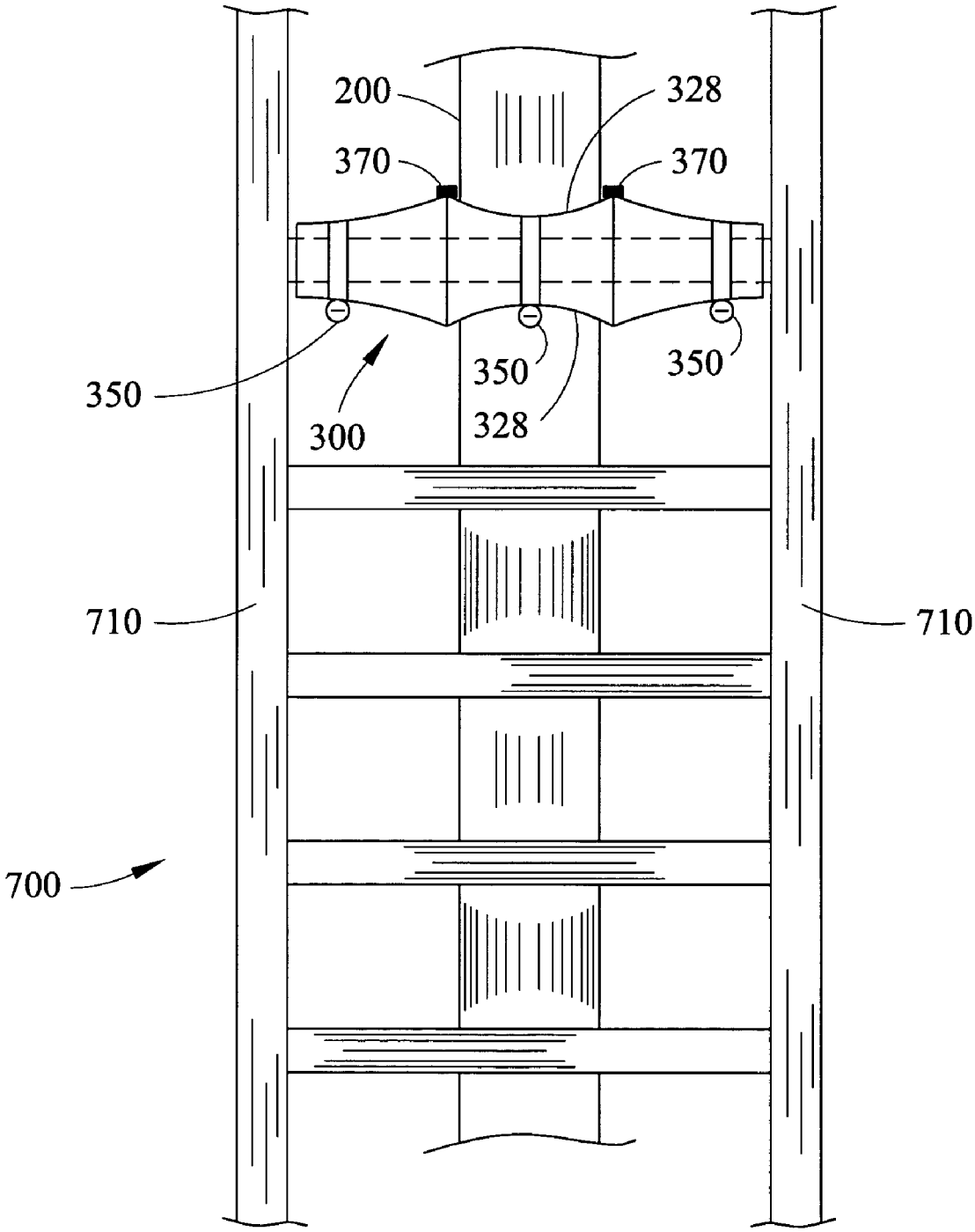
FIG. 13 is a front view of the ladder support of FIG. 11.

As shown in FIGS. 6-8, a third support member 140 may be included for use with a first support member 120 and a second support member 130. The third member 140 may be a separate member from the first and second members 120, 130, or it may otherwise be cojoined with these members 120, 130 to form a single unitary member. Third support member 140 may have a securing surface 142 for receiving a securing structure 100 for mounting to the securing structure 100. Third support member 140 may also utilize a fastener 150 for assisting third support member 140 in mounting to the securing structure (not shown). Third member 140 may also have a slit 145 to allow for placement over a securing structure (not shown). Third support member 140 may further be textured on the securing surface 142 to assist in improving contact with a securing structure (not shown).

Third support member 140 may be shaped generally in a concave manner to accommodate varying sizes and shapes of supporting structures 200 such as, for example, the pole 200 illustrated in FIG. 6. The inward shape of third support member 140 provides a supporting structure receiving area 148 for contacting the supporting structure 200. The supporting structure receiving area 148 may be shaped in various configurations. Third support member 140 may also have a textured supporting structure receiving area 148 to improve contact with the supporting structure 200.

FIGS. 9-13 illustrate a ladder support system 300 being sectioned into a first supporting portion 320 and a second supporting portion 330. The first and second supporting portions 320, 330 may be attached to one another by hinges 370. The first supporting portion 320 may have a securing surface 322 and an inner abutment end 324 and an outer abutment end 326. First supporting portion 320 may also have a support structure receiving area 328 for contacting a supporting structure 200. Opposite first supporting portion 320 is second supporting portion 330 having a securing surface 332, an inner abutment end 334 and an outer abutment end 336. Second supporting portion 330 may also have a support structure receiving area 338 for contacting a supporting structure 200. The support structure receiving areas 328, 338 and/or the securing surfaces 322, 332 may be textured to improve the contact it may have with either or both the support structure 200 or the securing structure 100 respectively. Ladder support system 300 may additionally have a slit 345 therethrough to allow for separation of first support portion 320 from second support portion 330.

To secure the ladder support system 300 to a ladder 700, the first and second support portions 320, 330 may be opened about their common hinges 370. The support portions 320, 330 may further be placed over a securing structure 100 and then fastened together such as, for example, with fasteners 350. One or more fasteners 350 may be utilized to secure ladder support system 300 to a securing structure 100 on a ladder 700. The supporting structure 200 may then be placed in the supporting structure receiving area 338 and/or supporting structure receiving area 328 to provide lateral support to a ladder 700.

Further implementations of the embodiments of the invention may include dividing the first and second support portions 320, 330 into several more portions connected via hinges 370 or other attachment means. Although two portions have been illustrated, other implementations may include further segregation of the first and second support portions 320, 330 connected by hinges 370.

Further embodiments may include other ways of attaching the ladder support system 300 that are within the spirit and scope of the embodiments of the invention. First and/or second support portions 320, 330 may attached directly to the sides of the ladder 700 on the beams 710 via snap fittings or threaded attachment means. In addition, the support portions 320, 330 may also slide into molded fittings (not shown) retrofitted onto existing beams 710 of the ladder 700.

Figure 14:
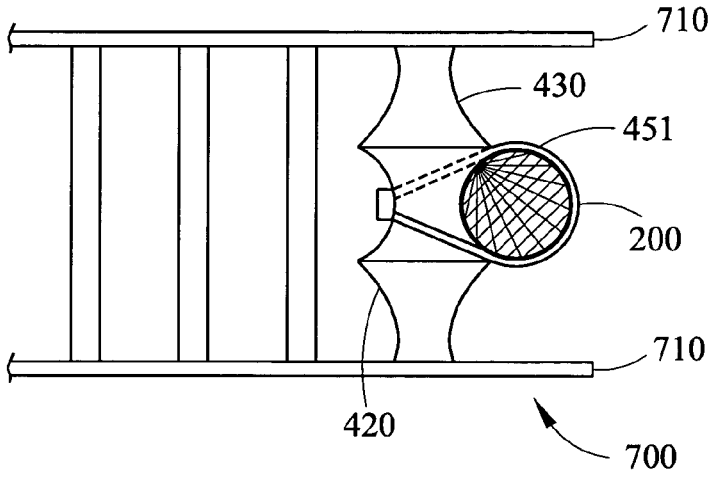
FIG. 14 is a top elevational view of the ladder support system of FIG. 11 as it may be employed in another of the embodiments of the present invention.
Figure 15:
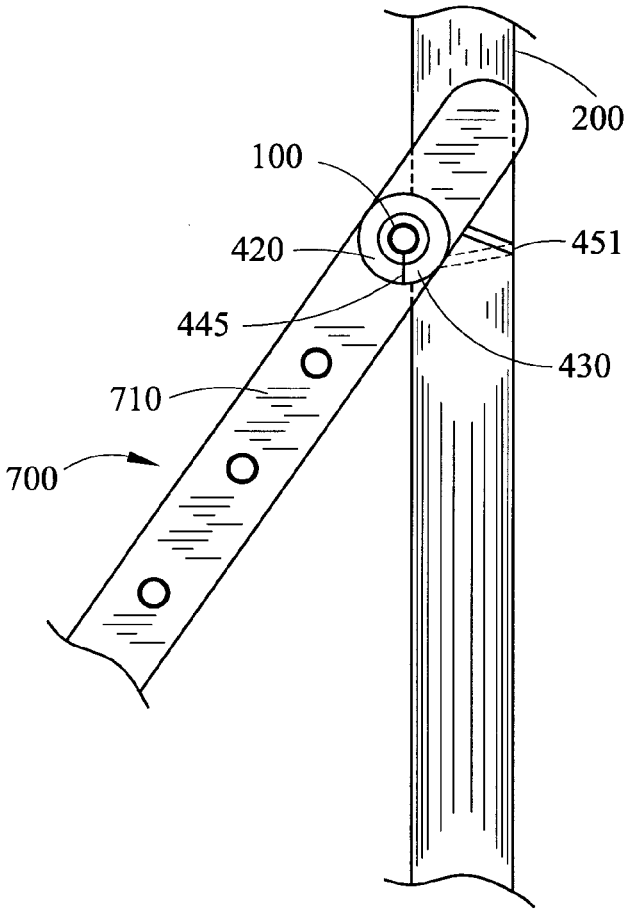
FIG. 15 is side view of the ladder support of FIG. 14.
Figure 16:
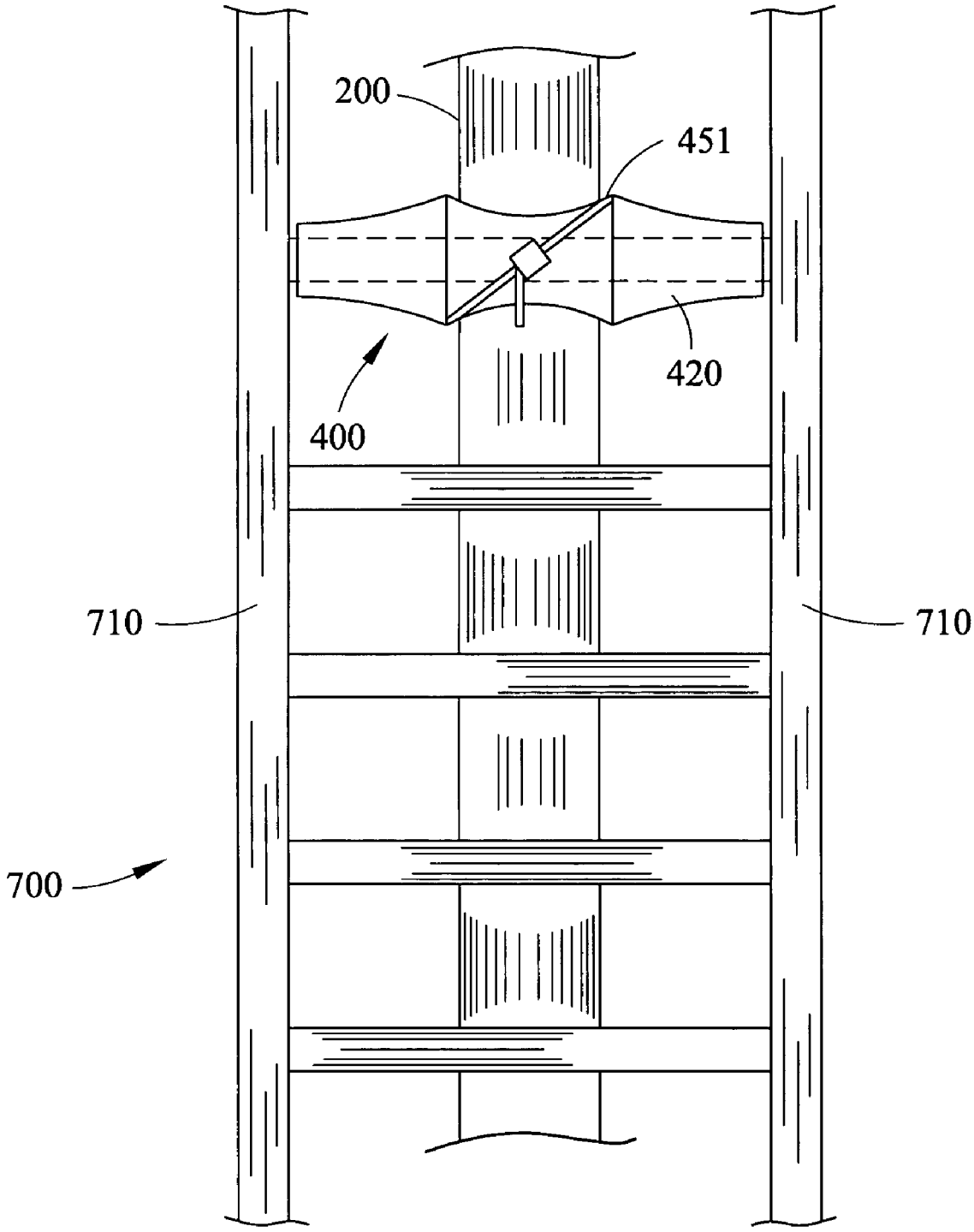
FIG. 16 is a front view of the ladder support of FIG. 14.

FIGS. 14-16 illustrate a ladder support system 400 is of a unitary construction having a slit 445 diving a first support portion 420 from a second support portion 430. Fastener 451 may be utilized to assist in retaining ladder support system 400 in a desired position. As can be seen in the drawings, fastener 451 may be positioned around the supporting structure 200 and the ladder support system 400.

Further implementations of attaching the ladder support system 400 are within the spirit and scope of the embodiments of the invention. First and/or second support portions 420, 430 may attach directly to the sides of the ladder 700 on the beams 710 via snap fittings or threaded attachment means. In addition, the support portions 420, 430 may also slide into molded fittings (not shown) retrofitted onto existing beams 710 of the ladder 700. This fastener 451 provides additional stability to the ladder support system 400 as it further prevents the ladder support system 400 from falling away from the supporting structure 200.

The embodiments of the present invention represent significant improvements over ladder stabilizing devices. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A ladder support for a ladder, the ladder having ladder beams and at least one rung disposed between the ladder beams, the ladder support comprising:

a first support member mounted on a first portion of a rung of the ladder, the first support member having a generally frustroconically-shaped outer surface having inner and outer abutment ends, the inner abutment end having a larger diameter than the outer abutment end, the first support member also having a cylindrically-shaped inner surface that extends from the inner abutment end to the outer abutment end, the cylindrically-shaped inner surface having a circular opening at the inner abutment end and another circular opening at the outer abutment end, the first support member also having a longitudinal slit extending through an inner portion from the outer surface to the inner surface, the first support member being of a resilient material such that the first support member may be pried open about the slit and deformed around the rung of the ladder, the first supporting member thus returning to its undeformed shaped when a deforming force is removed;

a second support member unconnected to the first support member, mounted on a second portion of the rung; and a supporting structure positioned between the first and second support members, wherein the first and second support members provide lateral support to the ladder by the first and second support members wedged between the ladder beams and the supporting structure.

2. The ladder support of claim 1 wherein the first support member includes at least one fastener and is thereby releasably mounted on the first portion of the rung.

3. The ladder support of claim 1, wherein the second support member also has a generally frustroconically-shaped outer surface having inner and outer abutment ends, the second support member's inner abutment end having a larger diameter than the outer abutment end, the second support member also having a cylindrically-shaped inner surface that extends from the inner abutment end to the outer abutment end, the second support member's cylindrically-shaped inner surface having a circular opening at the inner abutment end and other circular opening at the outer abutment end, the second support member also having a longitudinal slit extending through an inner portion from the outer surface to the inner surface, the second support member being of a resilient material such that the second support member may also be pried open about the slit and deformed around the rung of the ladder, the second supporting member thus returning to its undeformed shaped when the deforming force is removed.

* * * * *